US010501978B2

(12) United States Patent
Arimoto et al.

(10) Patent No.: US 10,501,978 B2
(45) Date of Patent: Dec. 10, 2019

(54) WINDOW REGULATOR CABLE GUIDE

(71) Applicant: Hi-Lex Controls, Inc., Rochester Hills, MI (US)

(72) Inventors: Shigeki Arimoto, Bloomfield Hills, MI (US); Ichiro Okuno, Rochester Hills, MI (US); Yohei Moriya, Rochester Hills, MI (US)

(73) Assignee: HI-LEX CONTROLS, INC., Rochester Hills, MI (US)

( * ) Notice: Subject to any disclaimer, the term of this patent is extended or adjusted under 35 U.S.C. 154(b) by 111 days.

(21) Appl. No.: 15/848,575

(22) Filed: Dec. 20, 2017

(65) Prior Publication Data

US 2019/0186188 A1 Jun. 20, 2019

(51) Int. Cl.

| | |
|---|---|
| ***E05F 15/689*** | (2015.01) |
| ***E05D 15/16*** | (2006.01) |
| ***E05F 15/60*** | (2015.01) |
| ***E05F 11/48*** | (2006.01) |

(52) U.S. Cl.

CPC ..... *E05F 15/689* (2015.01); *E05D 15/165* (2013.01); *E05F 11/483* (2013.01); *E05F 15/60* (2015.01); *E05Y 2201/66* (2013.01); *E05Y 2900/55* (2013.01)

(58) Field of Classification Search

None

See application file for complete search history.

(56) References Cited

U.S. PATENT DOCUMENTS

| | | | | |
|---|---|---|---|---|
| 4,433,508 | A | 2/1984 | Carletta | |
| 5,367,827 | A * | 11/1994 | Tajima | E05F 11/486 242/364 |
| 5,613,322 | A | 3/1997 | Kobrehel | |
| 5,617,675 | A | 4/1997 | Kobrehel | |
| 5,864,987 | A | 2/1999 | Mariel et al. | |
| 6,227,993 | B1 * | 5/2001 | Medebach | E05F 11/382 474/144 |
| 6,546,672 | B2 | 4/2003 | Tatsumi et al. | |
| 8,938,914 | B2 | 1/2015 | Hulst et al. | |
| 2002/0020116 | A1 * | 2/2002 | Arquevaux | E05F 11/485 49/349 |

(Continued)

FOREIGN PATENT DOCUMENTS

| | | | |
|---|---|---|---|
| CA | 2 436 370 A1 | 7/2002 | |
| CA | 2538433 A1 * | 9/2006 | B60J 5/0416 |

(Continued)

*Primary Examiner* — Marcus Menezes

(74) *Attorney, Agent, or Firm* — Brinks Gilson & Lione

(57) ABSTRACT

A cable guide for use with a window regulator assembly includes a body with a first rail support surface, a second rail support surface and a third rail support surface in a guide rail region and a cable support surface and a cable retention arm in a cable region. The first rail support surface is configured to be inserted through an aperture in a guide rail and be placed on a first side of the guide rail and a cable retention arm configured to receive a tensioned drive cable of the window regulator. The cable guide with the first, second and third rail support surfaces may be steadily assembled to the guide rail by utilizing the pushing force from the tensioned drive cable. The aperture is located along the guide rail such that the aperture is out of the slide path of the window carrier of the window regulator assembly.

18 Claims, 4 Drawing Sheets

(56) References Cited

U.S. PATENT DOCUMENTS

| | | | | |
|---|---|---|---|---|
| 2007/0069547 | A1* | 3/2007 | Kruger | B60J 1/17 296/146.2 |
| 2008/0005971 | A1 | 1/2008 | Dickie et al. | |
| 2009/0265993 | A1* | 10/2009 | Shah | B60J 5/0416 49/352 |
| 2011/0078957 | A1* | 4/2011 | Deschner | B60J 5/0416 49/352 |
| 2013/0168488 | A1* | 7/2013 | Debus | E05F 11/483 242/615.3 |
| 2017/0268273 | A1 | 9/2017 | Matsushita | |

FOREIGN PATENT DOCUMENTS

| | | | | |
|---|---|---|---|---|
| EP | 0930413 | A1 * | 7/1999 | E05F 11/483 |
| EP | 2466048 | A1 * | 6/2012 | E05F 11/483 |
| EP | 2 589 737 | A1 | 5/2013 | |
| JP | H 10-203162 | | 8/1998 | |
| JP | 2009-299429 | A | 12/2009 | |
| JP | 2013096127 | A * | 5/2013 | E05F 11/486 |
| KR | 100680740 | | 2/2007 | |
| WO | WO-2008138122 | A1 * | 11/2008 | B60J 5/0416 |
| WO | WO-2013065721 | A1 * | 5/2013 | E05F 11/486 |
| WO | WO 2014/155774 | A1 | 10/2014 | |

* cited by examiner

WINDOW REGULATOR CABLE GUIDE

FIELD OF THE INVENTION

The invention relates to a cable guide for use with an automotive window regulator assembly.

BACKGROUND

Passenger car motor vehicles have for many decades featured movable side door glass. A mechanism is required in order to move the glass between the upper closed position and the lower opened position. These mechanisms are generally known as window regulators. Window regulators can be manually operated, or can be driven by a powered actuator, most commonly using an electric motor. One type of window regulator uses a pulley arrangement having a metal cable wrapped around pulleys and a drum driven by an electric motor. Such devices typically use a carrier which engages the door glass. The carrier may be driven along a metal guide rail by the metal cable. Specifically, the electric motor drives the drum, thereby moving the cable about the pulley arrangement and driving the carrier to control the vertical motion of the window glass.

Due to the packaging constrains of some vehicle door panels and other design constraints the electric motor and cable drum of a window regulator assembly may be located near the bottom of the guide rail. In such assemblies, the metal cable spans the length of the guide rail unsupported. To support and guide the metal cable spanning the length of the guide rail, some window regulator assemblies include a cable guide that may be attached to the guide rail. The cable guide is primarily provided to avoid undesirable noise resulting from vibration of the unsupported cable and to adjust the location of the cable to provide clearance with other door components. Conventional cable guides are typically attached to the guide rail at approximately its center using welding or TOX (interlocking metal deformation) joining. Such cable guides also require a bracket be placed between the guide rail and the cable guide.

Despite the satisfactory performance of conventional cable guides, there is constantly a desire to reduced cost, increase ease of assembly, and reduce the weight of automotive components, while providing a desirable durability, low warranty claims, and compliance with performance requirements.

SUMMARY

The present disclosure relates to a cable guide for use with an automotive window regulator assembly which addresses the above-referenced desirable attributes. According to one form of the present disclosure, the cable guide includes a body having a guide rail region and a cable region. The guide rail region has a first rail support surface, a second rail support surface and a third rail support surface and the cable region has a cable support surface and a cable retention arm. The cable guide further includes a snap tab extended from one of the rail support surfaces. The cable retention arm has a first portion and a second portion. The first portion of the cable retention arm extends from the cable support surface. The second portion of the cable retention arm is cantilevered from the first portion such that an end of the second portion extends toward a first end of the body.

Further aspects of the invention are explained in greater detail below by means of preferred illustrative embodiment with reference to the attached drawings. The drawings are provided for purely illustrative purposes and are not intended to limit the scope of the present invention.

BRIEF DESCRIPTION OF THE DRAWINGS

Further details of the invention are described in more detail with reference to the drawings, in which.

DETAILED DESCRIPTION

Figure 1:
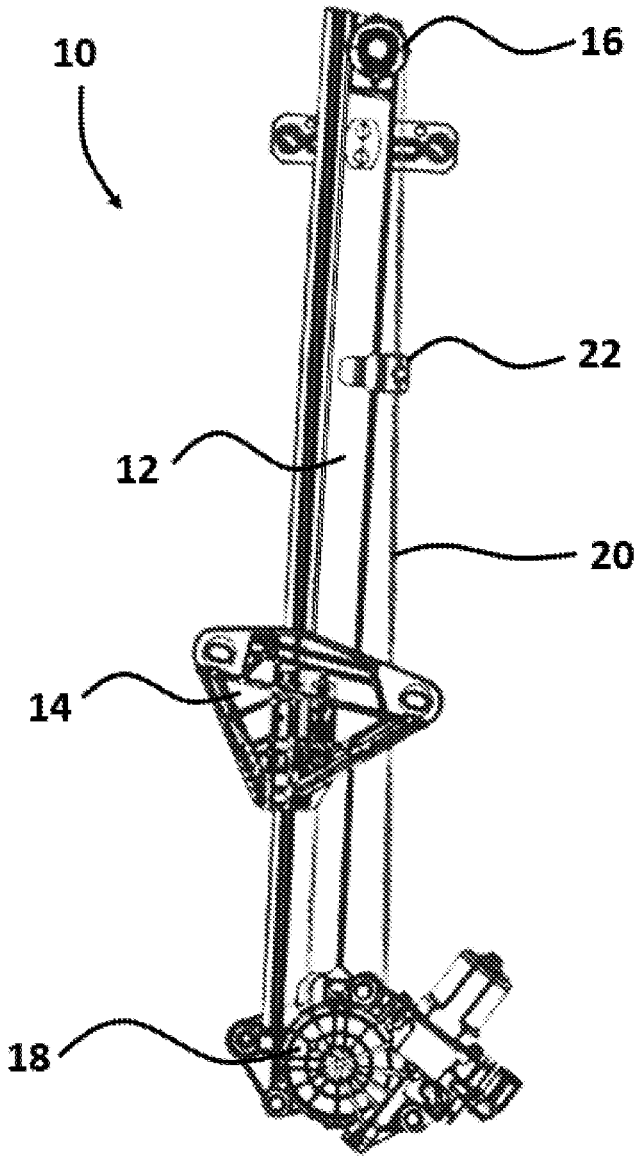
FIG. 1 is a perspective view of a window regulator assembly incorporating a cable guide in accordance with the present disclosure.

With reference to FIG. 1, a window regulator assembly 10 is illustrated, which includes as principal components, a guide rail 12, a window carrier 14, a cable deflector 16 such as a cable slider or a pulley, a motor drive assembly 18, a drive cable 20, and a cable guide 22. The guide rail 12 may be formed of sheet-metal using a forming or rolling process or as an extrusion. The window carrier 14 is caused to travel up and down along the guide rail 12 and includes a window clamp arrangement (not illustrated) which attaches to the lower edge of the vehicle side door glass (not illustrated).

The cable deflector 16 is positioned at the top of the guide rail 12 and acts to redirect and tension the drive cable 20. The motor drive assembly 18 positioned at the bottom of the guide rail 12 is actuated and powered electrically to move the drive cable 20. The drive cable 20 wraps around the cable deflector 16 and wraps around a pulley within the motor drive assembly 18 where it is driven. Ends of the drive cable 20 may terminate at attachment points on the window carrier 14. The drive cable 20 spans the entire length of the guide rail 12. A cable guide 22 in accordance with the present invention is attached to the guide rail 12 to support the drive cable 20 to reduce noise and rattle caused by vibration of the drive cable 20. The motor drive assembly 18 is affixed to the bottom of the guide rail 12 but could be positioned at other locations depending on application requirements. Similarly, the cable deflector 16 is shown at the top of the guide rail 12 but may be implemented in various other positions depending on the application. The cable guide 22 is attached to the guide rail 12 at a position along the length of the guide rail 12 between the motor drive assembly 18 and the cable deflector 16. The window regulator assembly 10 is shown as a single rail type system. Alternate implementations may use a pair of separated guide rails provided for better control of the movable glass or other panel.

Figure 2:
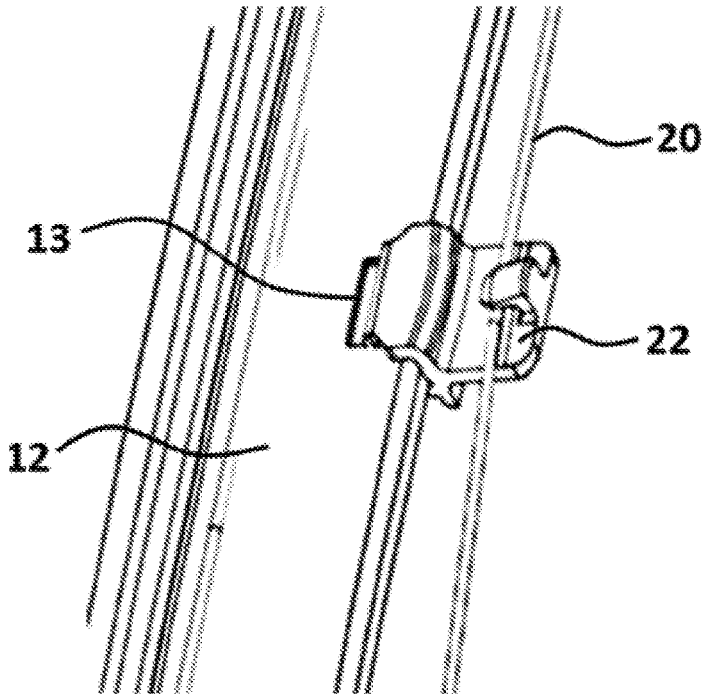
FIG. 2 shows an enlarged view of the cable guide of the present disclosure attached to a guide rail of the window regulator assembly of FIG. 1.
Figure 3:
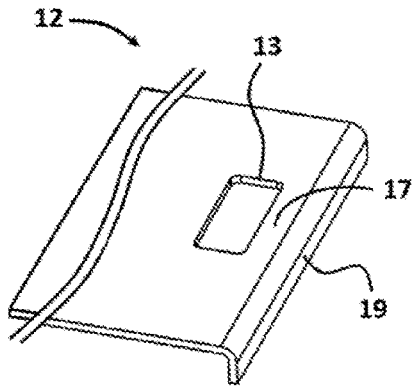
FIG. 3 shows an enlarged view of the guide rail.
Figure 5:
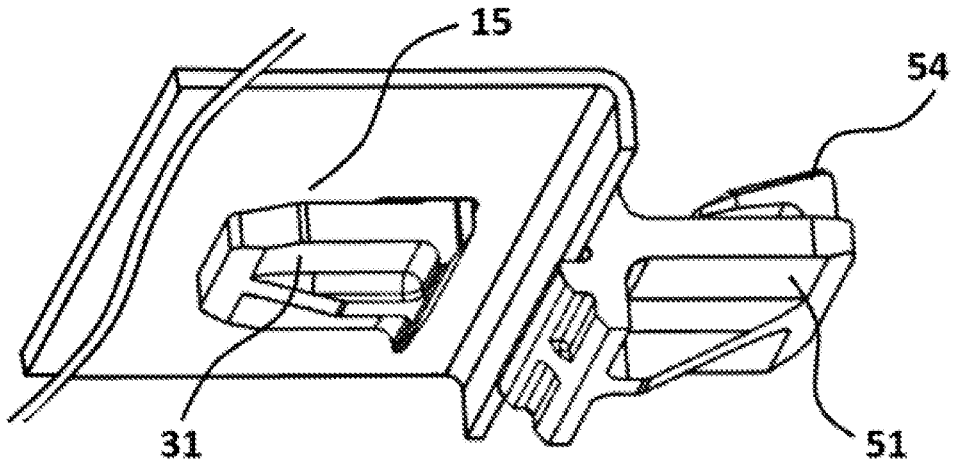
FIG. 5 is a bottom view of the cable guide in accordance with the present disclosure attached to the guide rail of the window regulator.

FIGS. 3 and 5 show a section of the guide rail 12 of the window regulator assembly 10. The guide rail 12 has a first side 15, a second side 17 and a third side 19. The first side 15 of the guide rail 12 is one side of the sheet-metal guide rail 12. The second side 17 of the guide rail 12 is opposite side from the first side 15 of the guide rail 12. As shown, the third side 19 of the guide rail 12 is perpendicularly bended from the second side 17 of the guide rail 12, however, other suitable angled shape may be implemented. An aperture 13 passes through the guide rail 12 near the third side 19 of the guide rail 12. The aperture 13 is located in an area of the guide rail 12 where the window carrier 14 does not slide on the guide rail 12 as the window carrier 14 moves the window glass between the open and closed positions. Locating the aperture 13 in such a position allows the use of a simple through hole for the aperture 13 rather than requiring a specially manufactured depression or depression and hole combination as is required by standard cable guides. Therefore, by locating the aperture 13 near the third side 19 of the guide rail 12 out of the path of the window carrier 14, the ease of guide rail 12 design and manufacturing is improved. The aperture 13 is located along the length of the guide rail 12 between the cable deflector 16 at one end of the guide rail 12 and the motor drive assembly 18 at another end of the guide rail 12. FIG. 2 shows the section of the guide rail 12 as shown in FIG. 3 with the cable guide 22 connected to the guide rail 12. The cable guide 22 attaches to the guide rail 12 at the aperture 13. When attached to the guide rail 12, the cable guide 22 retains and supports the drive cable 20 of the window regulator assembly 10.

Figure 4:
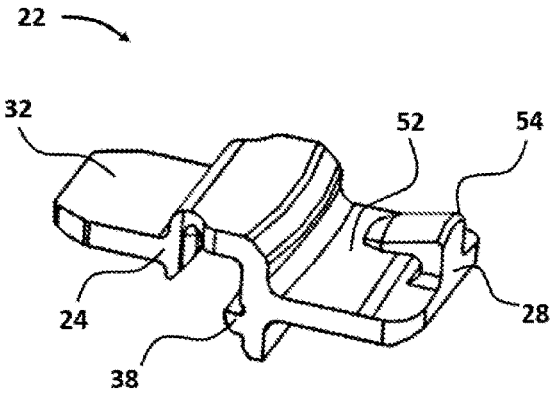
FIG. 4 is a perspective view of the cable guide of the present disclosure.
Figure 6:
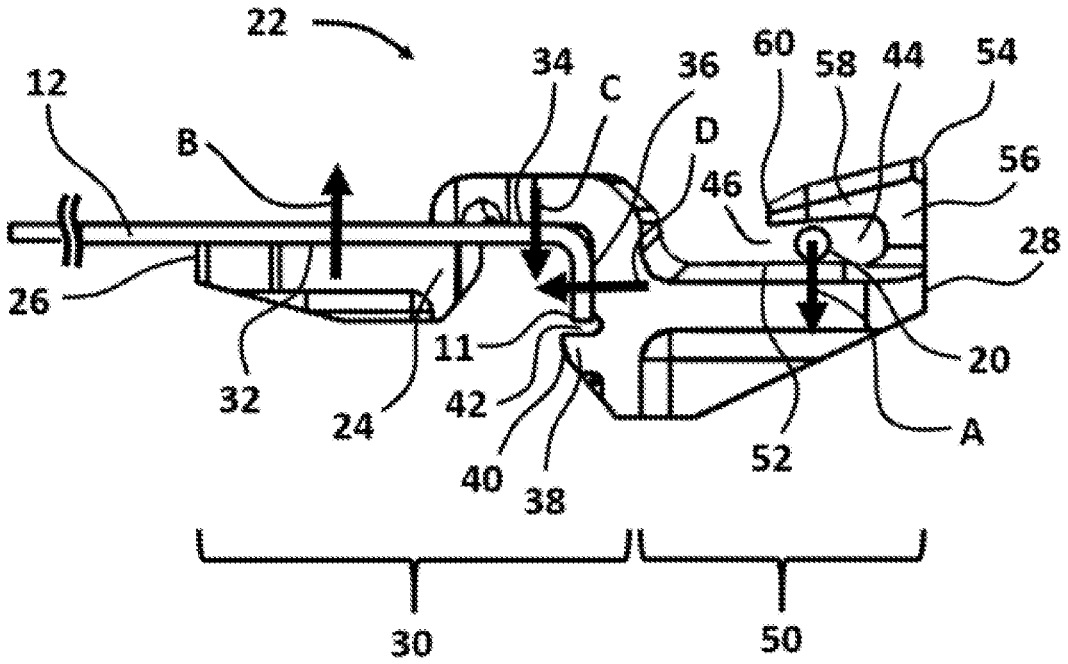
FIG. 6 shows a side view of the cable guide in accordance with the present disclosure attached to the guide rail of the window regulator.

Referring to FIGS. 4, 5 and 6, the cable guide 22 includes a body 24 that has a guide rail region 30 near a first end 26 of the body 24 and a cable region 50 near a second end 28 of the body 24. The guide rail region 30 has the first rail support surface 32, a second rail support surface 34 and a third rail support surface 36. The cable region 50 has a cable support surface 52 and a cable retention arm 54. The first rail support surface 32 and the cable support surface 52 are facing to the same direction. The first rail support surface 32 and the cable support surface 52 are positioned along what may be considered the top of the body 24, however, the terms top, bottom, side, etc. are simply used in this description to facilitate ease of understanding and are in no way intended to limit the scope of the disclosure. The cable guide 22 also includes a first bottom surface 31 in the guide rail region 30 and a second bottom surface 51 in the cable region 50. Each of the first and second bottom surface 31, 51 of the cable guide 22 may have various shapes to correspond to facilitating the installation of the cable guide 22 to the guide rail 12.

Figure 7:
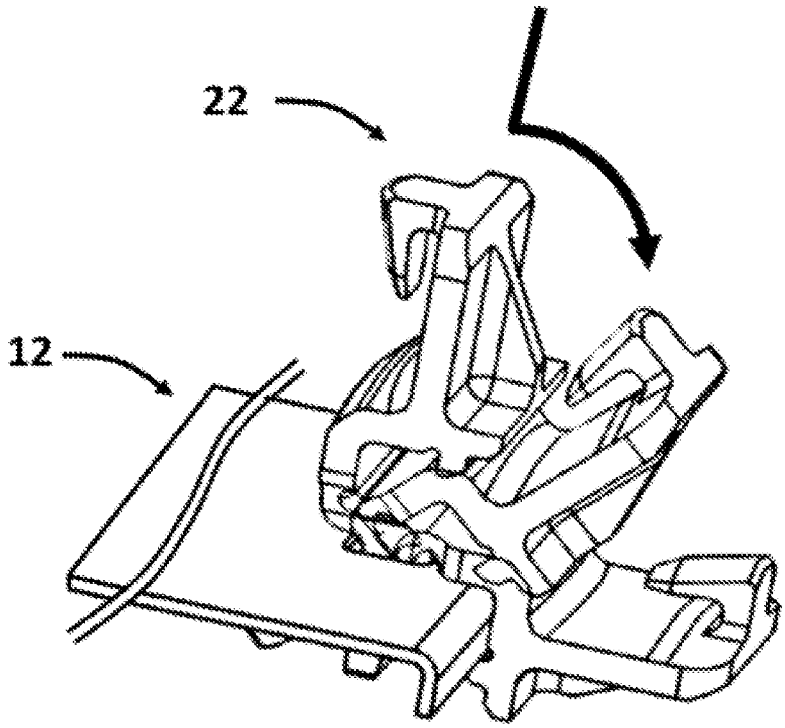
FIG. 7 is a perspective view of the cable guide attaching to the guide rail.

The region of the first rail support surface 32 of the body 24 is started from the first end 26 of the cable guide 22. As shown in FIGS. 6 and 7, the first rail support surface 32 is configured to be placed through the aperture 13 of the guide rail 12 and support the first side 15 of the guide rail 12. Accordingly, the first rail support surface 32 of the cable guide 22 is in contact with the first side 15 of the guide rail 12.

The region of the second rail support surface 34 of the body 24 is continued to the direction of the second end 28 of the body 24 from the region of the first rail support surface 32. The area where the region of the first rail support surface 32 transitions to the region of the second rail support surface 34 of the body 24 may be curved, stepped, angled or another geometry to correspond to facilitating the installation of the cable guide 22 to the guide rail 12. The second rail support surface 34 of the cable guide 22 is configured to be placed on the second side 17 of the guide rail 12. The facing direction of the second rail support surface 34 is opposite side from the facing direction of the first rail support surface 32. Accordingly, the second rail support surface 34 of the cable guide 22 is in contact with the second side 17 of the guide rail 12.

As shown in FIGS. 3 and 6, the region of the third rail support surface 36 of the body 24 is perpendicularly bended from the region of the second rail support surface 34, however, other suitable angled shape may be implemented for corresponding to the geometry of the guide rail 12. The third rail support surface 36 is configured to be placed on the third side 19 of the guide rail 12 and support the guide rail 12. Accordingly, the third rail support surface 36 of the cable guide 22 is in contact with the third side 19 of the guide rail 12.

The cable guide 22 further includes a snap tab 38. As shown in FIG. 6, the snap tab 38 is extended from the third rail support surface 36 to the direction of the first end 26 of the body 24. The snap tab 38 is perpendicular to the third rail support surface 36, however, other suitable angled shape may be implemented. An end 40 of the snap tab 38 is beyond the thickness of the guide rail 12. The snap tab 38 is configured to prevent separating the cable guide 22 from the guide rail 12 after the cable guide 22 is attached to the guide rail 12. The snap tab 38 is integrally formed with the body 24. The end 40 of the snap tab 38 may be curved, blunt, or another geometry to correspond to the geometry of the cable guide 22. As shown, the snap tab 38 and an edge 11 of the guide rail 12 define a gap 42 and the thickness of the gap 42 is equal to or greater than zero.

The cable guide 22 further includes a cable retention arm 54. The cable retention arm 54 is L-shaped and has a first portion 56 and a second portion 58. The cable retention arm 54 is integrally formed with the body 24. The first portion 56 and the second portion 58 are integrally formed. The area where the first portion 56 and the second portion 58 come together or where the first portion 56 transitions to the second portion 58 may be curved, tapered, or angled. The first portion 56 of the cable retention arm 54 extends from the cable support surface 52. The first portion 56 is perpendicular to the cable support surface 52. The second portion 58 of the cable retention arm 54 is cantilevered from the first portion 56 such that an end 60 of the second portion 58 extends toward the first end 26 of the body 24.

The second portion 58 of the cable retention arm 54 and the cable support surface 52 define a cable gap 44. The cable retention arm 54 is configured to receive a drive cable 20 of a window regulator 10 in the cable gap 44. The thickness of the cable gap 44 is equal to or greater than the thickness or diameter of the drive cable 20 such that the drive cable 20 fits in the cable gap 44. Since an opening side 46 of the gap 44 is the first end 26 direction of the body 24, the structure configuration of the cable retention arm 54 keeps the drive cable 20 retained within the cable gap 44. In an embodiment, the end 60 of the second portion 58 of the retention arm 54 may be thickened to retain the drive cable 20 in the cable gap 44.

Referring to FIG. 7, the cable guide 22 is attached to the guide rail 12 of the window regulator assembly 10 by first inserting the region of the first rail support surface 32 into the aperture 13 of the guide rail 12. After that, by rotating the cable guide 22 about the guide rail 12, the first rail support surface 32 is placed on the first side 15 of the guide rail 12. Continuing to rotate the cable guide 22 about the guide rail 12 causes each of the respective second and third rail support surface 34, 36 of the cable guide 22 to be placed on each of the respective second and third side 17, 19 of the guide rail 12. The snap tab 38 is positioned close to the edge 11 of the guide rail 12. Accordingly, each of the respective first, second and third rail support surface 32, 34, 36 of the cable guide 22 is in contact with each of the respective first, second and third side 15, 17, 19 of the guide rail 12.

As shown in FIG. 6, the drive cable 20 is inserted into the cable gap 44 between the cable retention arm 54 and the cable support surface 52. The drive cable 20 is configured to press against the cable support surface 52. The tensioned drive cable 20 exerts a force A on the cable support surface 52. In turns, the first rail support surface 32 exerts a force B on the first side 15 of the guide rail 12, and the second rail support surface 34 exerts a force C on the second side 17 of the guide rail 12. The third rail support surface 36 also exerts a force D on the third side 19 of the guide rail 12. Accordingly, each of the respective first, second and third surface 32, 34, 36 of the cable guide 22 is configured to press against each of the respective first, second and third side 15, 17, 19 of the guide rail 12. These forces are balanced to steadily secure the cable guide 22 to the guide rail 12 of the window regulator assembly 10.

Advantageously, the cable guide 22 is configured to reduce the overall weight and the packaging size of the window regulator assembly 10. In addition, the forces exerted by the tensioned drive cable 20 reduce looseness which can cause rattle and noise.

The cable guide 22 may be formed of a plastic material using an injection molding process or any other suitable manufacturing process.

While the above description constitutes the preferred embodiments of the present invention, it will be appreciated that the invention is susceptible to modification, variation and change without departing from the proper scope and fair meaning of the accompanying claims.

What is claimed is:

1. A cable guide for use with a window regulator having a guide rail, the cable guide comprising:

a body having a guide rail region and a cable region, the guide rail region having a first rail support surface, a second rail support surface and a third rail support surface and the cable region having a cable support surface and a cable retention arm, the first rail support surface disposed in an exterior surface of the body in the guide rail region, and configured to be placed through an aperture of the guide rail and contacted to a first side of the guide rail;

a snap tab extending from one of the rail support surfaces; and the cable retention arm having a first portion extending from the cable support surface and a second portion cantilevered from the first portion such that an end of the second portion extends toward a first end of the body.

2. The cable guide of claim 1, wherein the aperture is located along the guide rail between a window regulator motor at one end of the guide rail and a window regulator cable deflector at another end of the guide rail.

3. The cable guide of claim 1, wherein the second rail support surface of the guide rail region is configured to be placed on a second side of the guide rail, and wherein the second side of the guide rail is opposite side from the first side of the guide rail.

4. The cable guide of claim 3, wherein the third rail support surface of the guide rail region is configured to be placed on a third side of the guide rail, and wherein the third side of the guide rail is perpendicularly bended from the second side of the guide rail.

5. The cable guide of claim 4, wherein each of the respective first, second and third rail support surfaces are configured to press against each of the respective first, second and third side of the guide rail.

6. The cable guide of claim 1, wherein the second portion of the cable retention arm and the cable support surface define a cable gap, and wherein the cable retention arm is configured to receive a window regulator cable in the cable gap.

7. The cable guide of claim 6, wherein the window regulator cable in the cable gap is configured to press against the cable support surface.

8. The cable guide of claim 1, wherein the first rail support surface and the cable support surface are facing to the same direction.

9. The cable guide of claim 1, wherein the snap tab is extended from the third rail support surface and integrally formed with the body.

10. The cable guide of claim 1, wherein the cable retention arm is integrally formed with the body.

11. The cable guide of claim 1, wherein the cable guide is formed of a plastic material using an injection molding process.

12. A cable guide for use with a window regulator having a guide rail, the cable guide comprising:

a body having a first rail support surface, a second rail support surface, a third rail support surface and a cable support surface, the first rail support surface disposed in an exterior surface of the body, and configured to be placed through an aperture of the guide rail and contacted to a first side of the guide rail;

a snap tab extending from one of the rail support surfaces; and a cable retention arm having a first portion extending from the cable support surface and a second portion cantilevered from the first portion, and wherein the cable guide is configured to interlock with the guide rail.

13. The cable guide of claim 12, wherein the aperture is located along the guide rail between a window regulator motor at one end of the guide rail and a window regulator cable deflector at another end of the guide rail.

14. The cable guide of claim 12, wherein the second rail support surface is configured to be placed on a second side of the guide rail, and wherein the second side of the guide rail is opposite side from the first side of the guide rail.

15. The cable guide of claim 14, wherein the third rail support surface is configured to be placed on a third side of the guide rail, wherein the third side of the guide rail is perpendicularly bended from the second side of the guide rail, and wherein the snap tab is extended from the third rail support surface.

16. The cable guide of claim 15, wherein each of the respective first, second and third rail support surfaces are configured to press against each of the respective first, second and third side of the guide rail to stabilize the cable guide on the guide rail.

17. The cable guide of claim 12, wherein the second portion of the cable retention arm and the cable support surface define a cable gap, and wherein the cable retention arm is configured to receive a window regulator cable in the cable gap.

18. The cable guide of claim 17, wherein the window regulator cable is configured to press against the cable support surface.

* * * * *